United States Patent [19]

Minshew, Jr. et al.

[11] Patent Number: 4,498,510

[45] Date of Patent: Feb. 12, 1985

[54] DEVICE FOR DRAWING, HOLDING AND DISPENSING LIQUID

[76] Inventors: Edward C. Minshew, Jr., 3271 F Matthews, Fort Worth, Tex. 76118; Ray F. Chesley, 2903 Meadow Ave., Norman, Okla. 73069

[21] Appl. No.: 409,824

[22] Filed: Aug. 20, 1982

[51] Int. Cl.[3] ..... B65B 3/04

[52] U.S. Cl. ..... 141/27; 141/242; 141/258; 73/864.13; 73/864.18; 222/108; 222/386.5; 222/571; 422/100

[58] Field of Search ..... 141/130, 178, 234, 2, 141/18, 27, 65, 66, 67, 235-248, 115-127, 141/258-262; 222/571, 108, 386.5, 386, 504; 73/864.13, 864.18, 864.14, 864.16; 422/100

[56] References Cited

U.S. PATENT DOCUMENTS

| | | | |
|---|---|---|---|
| 2,241,840 | 5/1941 | Achtziger | 222/571 |
| 3,738,539 | 6/1973 | Beich | 222/386.5 |
| 3,855,868 | 12/1974 | Sudvaniemi | 73/864.18 |
| 4,056,360 | 11/1977 | Risch | 73/864.18 |
| 4,298,575 | 11/1981 | Berglund | 73/864.13 |

FOREIGN PATENT DOCUMENTS

| | | | |
|---|---|---|---|
| 2749186 | 5/1979 | Fed. Rep. of Germany | 222/504 |

*Primary Examiner*—Houston S. Bell, Jr.

*Attorney, Agent, or Firm*—Chris H. Morgan

[57] ABSTRACT

A device for drawing, holding and dispensing a plurality of distinct, relatively low volume, liquid masses. A plunger plate with an array of plungers is received in a draw tube plate with an array of draw tubes. A piston tip is sealingly disposed in the draw tubes and the plungers are connected thereto. The draw tube plate can be received by a reservoir plate such that the draw tubes extend into an array of wells in the reservoir plate. By finger pressure the plunger plate can be reciprocated with respect to the draw tube plate to move the pistons in the draw tubes for drawing, holding and dispensing a plurality of distinct liquid masses. Preferably the pistons have an inverted concave, conical tip shape and mate with an inner, lower surface of the draw tubes.

16 Claims, 14 Drawing Figures

DEVICE FOR DRAWING, HOLDING AND DISPENSING LIQUID

BACKGROUND OF THE INVENTION

1. Field of the Invention

This invention relates generally to devices for drawing, holding and dispensing liquids and more particularly to devices for simultaneously drawing, holding and dispensing a plurality of distinct liquid masses.

2. Description of the Prior Art

There are presently several devices available for drawing, holding and dispensing liquids. Such devices include medicine droppers, pipettes, capillary tubes, syringes, and the like. While these devices have been useful they have their disadvantages.

One particular problem with the devices utilized for dispensing liquids is accuracy. In devices which dispense small amounts of liquids the amount of wetted surface and droplet formation has been a problem in accurate dispensing. For example, if a droplet forms on the end of the dispensing device during the process of dispensing the device cannot be more accurate than the volume of the droplet formed. Gaps between moving parts of dispensing devices also can be a source of inaccuracy. For example, if an air space forms between the plunger of a syringe and the syringe wall when liquid is drawn up this air space prevents the syringe from dispensing more accurately than the volume of the air space. These same gaps can remain filled with a liquid when liquid is dispensed creating further inaccuracy.

Another problem with devices for drawing, holding and dispensing liquids has been that they are tedious to use. Thus, where liquid must be transferred to or from a number of liquid-containing wells, use of prior art devices can be extremely time consuming. This is especially true where accuracy of drawing and dispensing is required.

It is accordingly an object of the present invention to provide an improved device for drawing, holding and dispensing liquids and particularly such a device which can simultaneously draw, hold and dispense a plurality of distinct liquid masses. In this manner, simultaneous drawing, holding and dispensing liquid from an entire array of liquid containing wells can be achieved.

It is another object of the present invention to provide such an improved drawing, holding and dispensing device which has improved accuracy and is easy to use.

Still a further object of the invention is to provide such a drawing, holding and dispensing device which can be operated manually and particularly with a single hand.

SUMMARY OF THE INVENTION

In accordance with the objects, the present invention provides a device for drawing, holding and dispensing a plurality of distinct liquid masses. It includes a reservoir plate having a plurality of liquid reservoirs disposed in an array configuration therein. A draw tube plate having a draw tube plate frame is provided for placing upon and mating with the reservoir plate. The draw tube plate frame has a plurality of draw tubes extending through and connected to it. These draw tubes are disposed in an array configuration such that when the draw tube plate frame is placed upon and mated with the reservoir plate each of the draw tubes extends into a selected one of the liquid reservoirs for drawing liquid therefrom or dispensing liquid thereto.

A plunger plate having a plunger plate frame is captively received by the draw tube plate frame for sliding reciprocating motion therewith. The plunger plate includes a plurality of plungers connected to the plunger plate frame and extending therefrom in an array configuration. The array configuration is such that each of the plungers sealingly extends into a selected one of the draw tubes of the draw tube plate for drawing liquid into and dispensing liquid from the draw tubes responsive to reciprocating motion of the plunger plate frame with respect to the draw tube plate frame.

A spring means resiliently urges the draw tube plate frame away from the plunger plate frame. In one embodiment the spring means comprises a set of resiliently elastomeric plunger pistons. The draw tube plate frame includes a hand grip surface for manual gripping and holding of the draw tube plate frame and the plunger plate frame includes a finger press surface for manually pressing the plunger plate frame toward the draw tube plate frame. These two surfaces are located for single hand reciprocating motion of the plunger plate frame with respect to the draw tube plate frame.

Preferrably, each of the plungers of the plunger plate includes a rod and a piston. Each piston is preferrably provided with an inverted concave, conical, lower surface shape which mates with an inverted convex, conical, inner lower surface of the draw tube. The mating connection of these surfaces provides for accurate dispensing of relatively small amounts of liquid.

Also preferrably, the device includes a means for regulating the upward stroke of the reciprocating sliding motion between the plunger plate and the draw tube plate. This allows the device to draw, hold and dispense different predetermined amounts of liquid.

For a further understanding of the invention and further objects, features and advantages thereof, reference may now be had to the following description taken in conjunction with the accompanying drawings.

DESCRIPTION OF PREFERRED EMBODIMENTS

Figure 1:
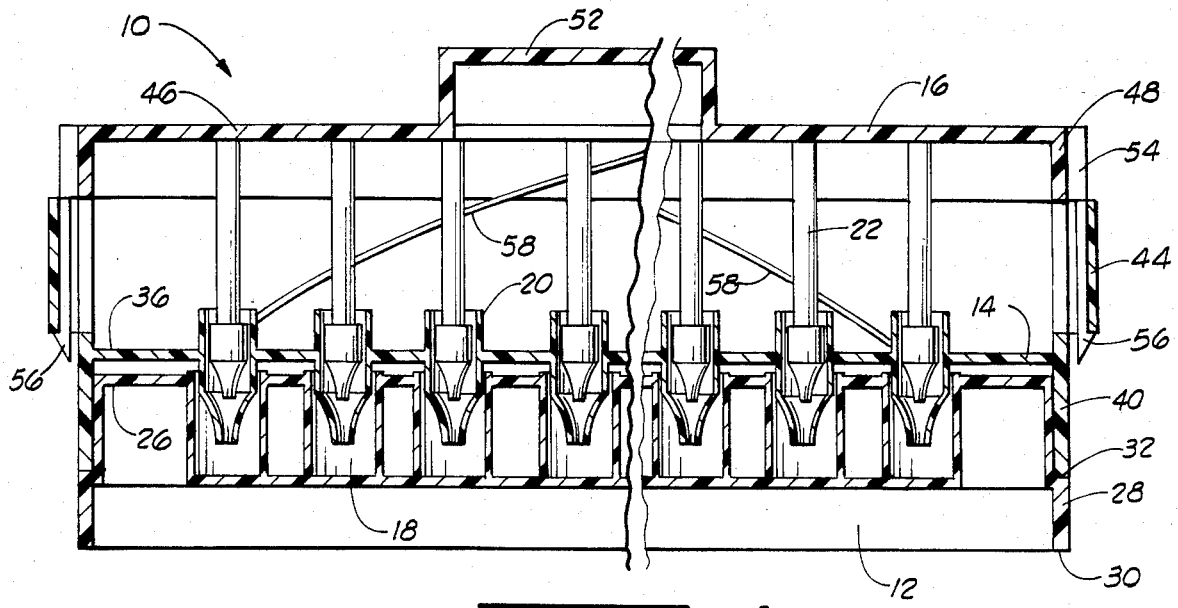
FIG. 1 is a side cross-sectional view of a device constructed in accordance with the present invention taken along the lines shown in FIG. 3.
Figure 2:
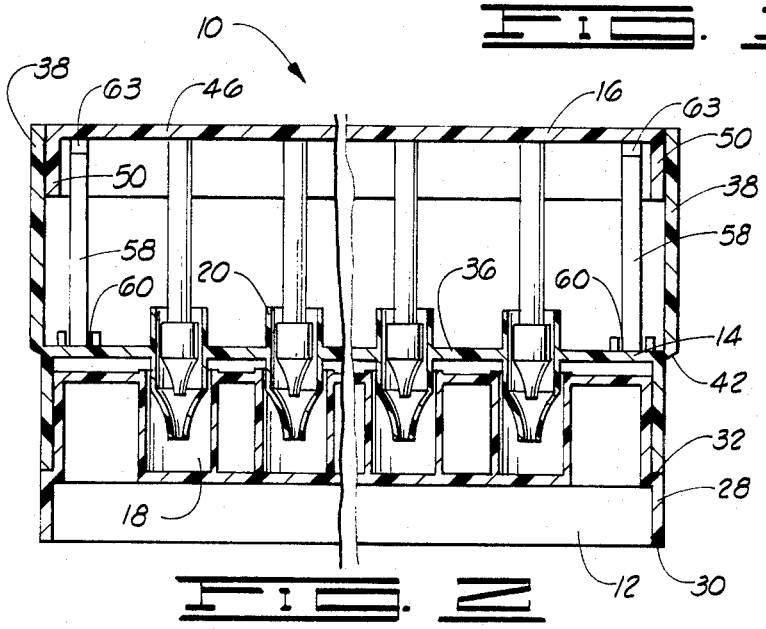
FIG. 2 is an end cross-sectional view of the device shown in FIG. 1 taken along the lines shown in FIG. 3.
Figure 3:
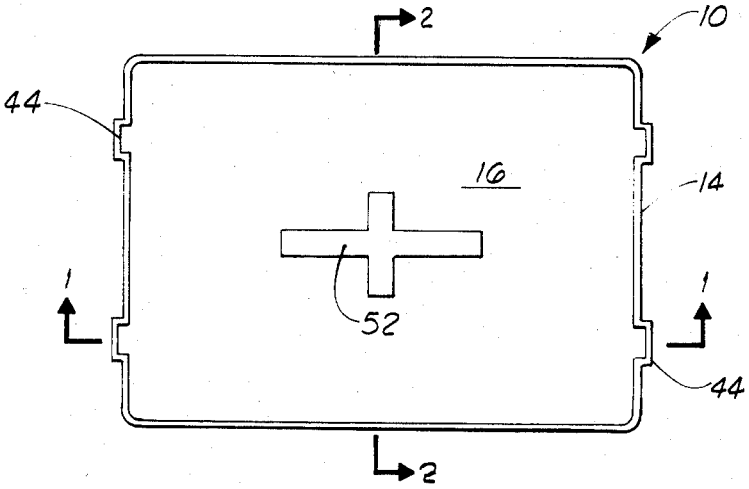
FIG. 3 is a plan view of the device of FIGS. 1 and 2.
Figure 4:
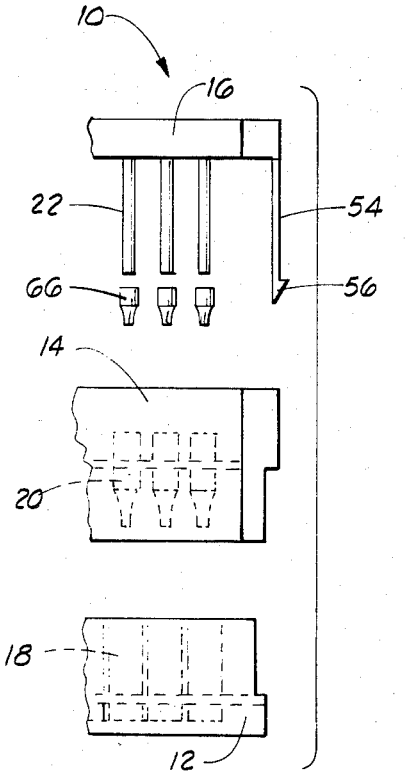
FIG. 4 is a partial side exploded view of the device shown in FIG. 1.

Referring now to FIGS. 1-4 the present invention is shown generally at 10. The device 10 includes a reservoir plate 12, a draw tube plate 14 and a plunger plate 16. The reservoir plate 12 has therein an array of liquid wells or reservoirs 18, draw tube plate 14 has an array of draw tubes 20, and plunger plate 16 has an array of plungers 22. The array of reservoirs 18, draw tubes 20 and plungers 22 all correspond so that each plunger fits within a draw tube which in turn fits within a reservoir.

The reservoir plate 12 has an 8×12 array of wells 18. The plate 12 is formed of a single piece of molded plastic, such as crystal styrene. Supporting the reservoirs 18 is a reservoir plate frame 24. The frame 24 has an upper surface 26 which extends around and is connected to the array of reservoirs 18. Each of the reservoirs 18 is connected to its neighbors to form a solid array of reservoirs. Extending downwardly from the outer edge of surface 26 is a reservoir skirt 28. The lower edge 30 of skirt 28 acts as a base to support the frame 24 and the array of reservoirs 18. The upper portion of skirt 28 is recessed forming a shoulder 32.

Reservoir plates of the type shown and described are well known presently and are utilized mainly in the biological fields for culturing bacteria and the like or for growing antibodies or other cells. Such plates are frequently referred to as microwell plates since the liquid in each well is measured in microliters; usually containing from 150 to 250 microliters. In the past, liquids have been transferred to and from each of the wells in such reservoir plates by means of individual drawing and dispensing devices.

A cover plate (not shown) can be utilized to cover the reservoirs 18 when liquid is not being transferred. The cover plate extends over surface 26, mates with the skirt 28 and rests on the shoulder 32. Some reservoir plates in the past have utilized keyed skirts to insure that covers are replaced with the same orientation each time and to indicate the orientation of the reservoir array. The present invention can utilize such keyed plates to allow only one orientation of the draw tube plate 14.

The draw tube plate 14 consists of a draw tube frame 34 through which the array of draw tubes 20 extend. The draw tube frame 34 has a horizontal surface 36 surrounded by and enclosed by side panels 38 and end panels 40. The draw tubes 20 which extend through the horizontal surface 36 are attached at an outside mid-portion thereof to the horizontal surface 36. The tubes 20 extend vertically.

The side panels 38 and end panels 40 of the draw tube plate 14 extend vertically and are joined at their edges. The upper portion of the side panels 38 and end panels 40 are slightly larger in circumference than the lower portions of these panels. Thus, a peripheral shoulder 42 extends around the draw tube plate 14. This shoulder 42 can be utilized as a grip surface for gripping and holding the draw tube plate.

Each of the end panels 40 of the draw tube plate 14 has a pair of channel shaped open extensions 44 in the upper portion thereof. These extensions 44 interlock with and guide the plunger plate 16.

As with the reservoir plate, the draw tube plate 14 is formed of a single piece of molded plastic, such as crystal styrene.

The plunger plate 16 has a frame partially formed by an upper horizontal surface 46. This surface covers the draw tubes 20 so that the reservoirs 18 are completely covered during liquid transfer. The array of plungers 22 are connected to and extend downwardly from surface 46. End panels 48 and side panels 50 extend downwardly from the periphery of surface 46.

Extending upwardly from a mid-portion of the surface 46 is a raised surface 48. This raised surface 48 has a cross configuration and extends between the array of plungers 22 (this facilitates molding of the plunger plate).

Extending outwardly and downwardly from the end panels 48 of the draw tube plate 14 are pairs of guide fingers 54 which are received within and interlock with the extensions 44. These guide fingers 54 extend resiliently against and within the channel shaped extensions 44, outside the lower portion of end panels 40, to guide the plunger plate frame with respect to the draw tube plate frame 34 and to limit the upward travel of the plunger plate 16. A small beveled flange 56 extends outwardly at the lower end of each finger 54 to captively retain the plunger plate from moving apart from the draw tube plate further than the beveled flange 56.

The side panels 50 and the end panels 48 of plunger plate 16 fit closely within the upper portion of side panels 38 and end panels 40 of draw tube plate 14. This close fit, together with the mating connection between fingers 54 and extensions 44 guide the movement of plunger plate 16 with respect to draw tube plate 14.

Figure 5:
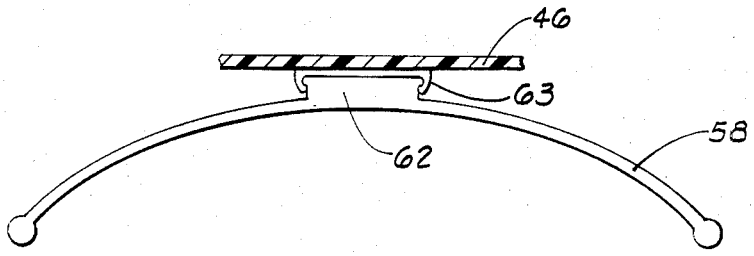
FIG. 5 is a side cross-sectional view of the device of FIG. 1 showing a flat spring portion of the invention.

Referring now additionally to FIG. 5 it can be seen that a pair of flat springs 58 are attached to the underneath of the sides of surface 46 and extend downwardly to the surface 36 of draw tube plate 14. The lower ends of the flat spring 58 are rounded and ride in grooves 60 disposed in the surface 36 of draw tube plate 14. The flat springs 58 are constructed of plastic.

The flat springs 58 have a mounting head 62. This mounting head 62 with ears extending therefrom is resiliently press fit and interlocked into a mating flanged groove 63 molded in the underside of surface 46. This allows the springs 58 to be formed separately from the plunger plate 16 yet connected thereto.

Of course the spring 58 must be constructed of a resilient material such as an acetal resin. Other plastics could also be used. If the springs 58 are formed as a single piece with plunger plate 16, the entire plate must be constructed of this resilient type plastic.

The springs 58 resliently urge the plunger plate 16 away from the draw tube plate 14. Thus, by finger pressure on the raised surface 52 of plunger plate 16, the plunger plate 16 will move downwardly toward the draw tube plate 14. When this pressure is removed the plates move apart. A reciprocating motion between the two plates can thus be achieved by the finger pressure described. This reciprocating motion can occur with the plates held suspended in a single hand.

Figure 7:
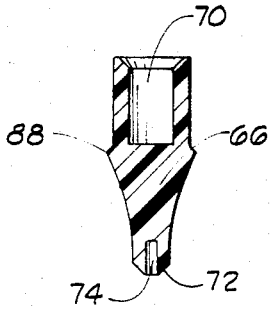
FIG. 7 is an enlarged side cross-sectional view of a piston of the device shown in FIG. 1.
Figure 8:
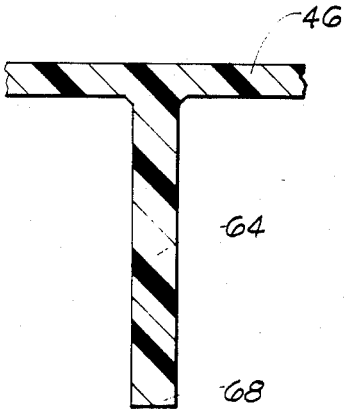
FIG. 8 is an enlarged side cross-sectional view of a rod portion of the device shown in FIG. 1.

Referring now also to FIGS. 7 and 8, it can be seen that the plungers 22 consist of a rod 64 and a piston 66. The rod 64 is cylindrical with a uniform diameter through its length and extends vertically downwardly from surface 46 of plunger plate 16. The lower cylindrical end 68 snuggly fits within a cylindrical cavity 70 in the upper end portion of the piston 66. This allows the piston 66 to be molded separately from the rod 64 and the plunger plate 16 so that a more precise molding of the piston 16 can be achieved at relativey low cost. Moreover, in some instances it may be desirable to provide disposable pistons 66 in connection with a reusable plunger plate 16.

The lower, pointed portion of piston 66 has an inverted concave conical shape. In other words, the lower portion of the piston is generally conical in shape and points downwardly. The cone has an inwardly curving surface as opposed to a flat surface.

The extreme tip 72 of piston 66 has a highly beveled cone shape, approximately 45° to the axis of the piston. This relatively small surface and the bevel angle help to prevent droplet formation on the tip 72 of the piston 66. A cylindrical hole 74 extends axially into the tip 72. The hole 74 also prevents formation of a droplet on the end of piston 66. The hole 74 is sufficiently small so that liquid surface tension prevents liquid from entering the hole 74. Typically, the hole 74 would have a diameter small than 0.1 inch.

Figure 6:
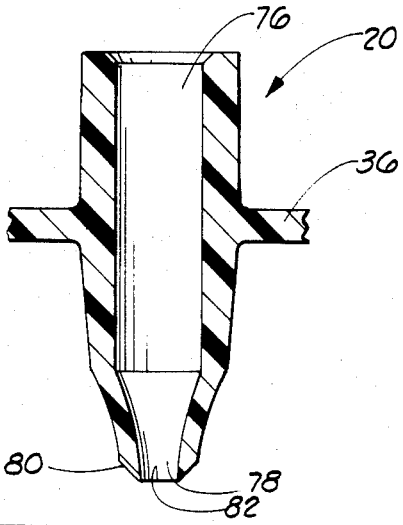
FIG. 6 is an enlarged side cross-sectional view of a draw tube portion of the device shown in FIG. 1.

Referring now also to FIG. 6, a draw tube 20 is shown in enlarged detail. Extending a major portion of the length of draw tube 20 is a cylindrical inner surface 76. Beneath this inner surface 76 is an inverted generally conical surface which mates with the lower end of piston 66. Particularly the surface has an inverted, convex, conical shape which precisely mates with the piston 66. The resiliency of the plastic in tube 20 and piston 66 and the curved shape of the mated portions of piston 66 and tube 20 squeezes the liquid downwardly out from the space between piston 66 and tube 20 as the device dispenses liquid. This squeezing action results from higher pressure at the upper ends of the inverted cones due to their more perpendicular disposition of the mating surfaces with respect to the direction of piston movement. This increases the accuracy of the dispensing. A reverse curvature to the one described would result in squeezing the liquid upwardly when the piston and tube surfaces meet.

The extreme end 78 of tube 20 has a relatively narrow beveled surface 80 approximately 45° to the tube axis and an axial hole 82 the same diameter as the extreme end 72 of piston 66. As with the piston 66, this relatively small end and opening together with the angle of the beveled surface 80, prevent droplet formation on the end of the tube 20.

One of the most important features of the present invention is accuracy in drawing and dispensing small volumes of liquid. In this regard, dimensions and shapes are very important. For example, the outside lower end of the tube is increasingly tapered toward its tip to allow a smaller volume of liquid displacement as the tube resides in a liquid-filled reservoir 18.

Typically a reservoir 18 has a diameter of less than 0.4 inches, a depth of less than 0.5 inches, and a volume capacity of less than 300 microliters. It is often desirable to draw 50 to 100 microliters from the liquid in such wells. In the embodiment shown in FIGS. 1 through 8 the reservoir has a 0.3 inch diameter and depth of 0.375 inches. The present invention is designed to draw liquid in predetermined volumes in the range of 1 to 100 microliters depending on the stroke of the piston. The upper, inside diameter of the cylinder is 0.138 inches and the upper, outside diameter of the cylinder is 0.250 inches. The convex conical inner surface of the tube and the convcave conical outer surface of the piston have a curvature of approximately 0.4 inches radius. The conical surfaces have an axial height of approximately 0.175 inches. The stroke of the piston for 100 microliters is approximately 0.5 inches. The displacement in approximately 175 microliters of fluid in a reservoir is approximately 75 microliters.

The pistons 66 have a sharp conical edge 88 which extends outwardly from the piston at the top of the inverted conical tip. The edge 88 sealingly engages the cylindrical inner surface 76 of the tube 20. By this seal the drawing and dispensing is achieved without fluid loss.

The pistons 66 are formed of a resilient plastic of 40 durometer or less. This provides a resilient seal at the interfaces between the piston tube and rod.

Figure 9:
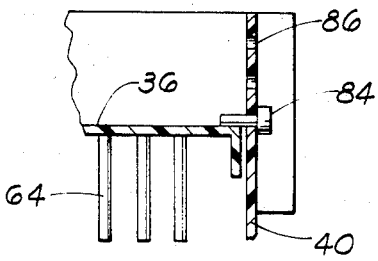
FIG. 9 is a partial side cross-sectional view of the device shown in FIG. 1.

Referring now to FIG. 9 an embodiment which allows restricted motion of plunger plate 16 with respect to draw tube plate 14 is illustrated. In this embodiment a pin 84 can extend through a selected one of holes 86 in end panels 40. The holes 86 are disposed at predetermined levels of end panels 40 to provide predetermined stroke lengths of piston 66 in tube 20. The end of pin 84 encounters the surface 46 of plunger plate 16 to stop its movement and the movement of piston 66 in tube 20 when this predetermined stroke is achieved.

Figure 10:
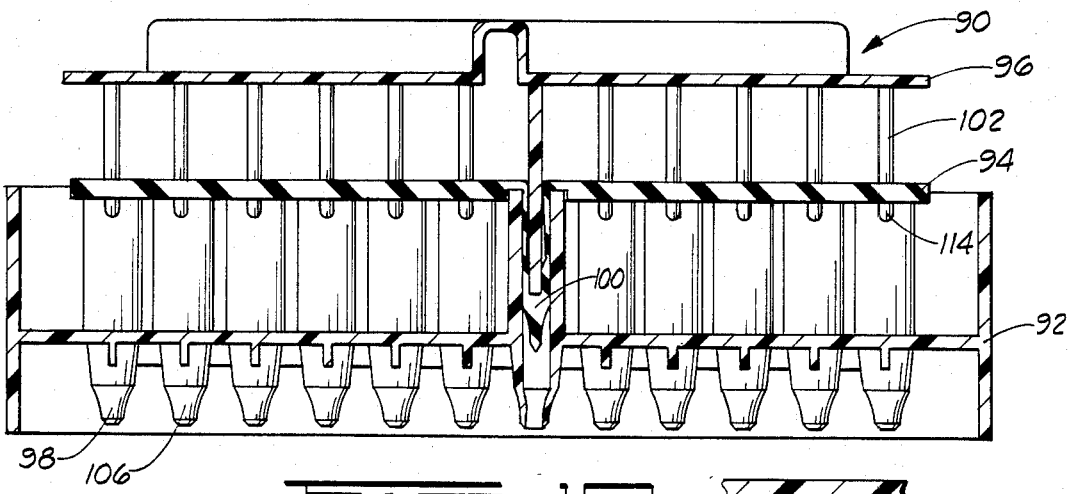
FIG. 10 is a side cross-sectional view of an alternate embodiment device of the present invention shown generally along the same lines as FIG. 1.
Figure 11:
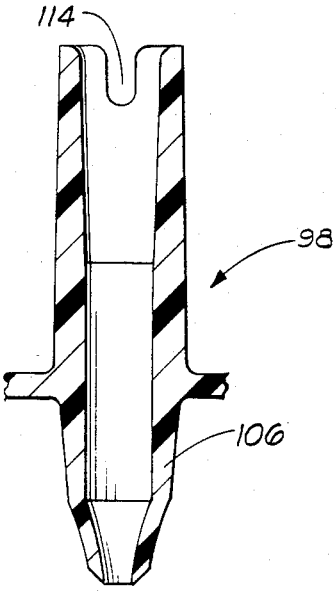
FIG. 11 is an enlarged side cross-sectional view of a draw tube portion of the device shown in FIG. 10.
Figure 12:
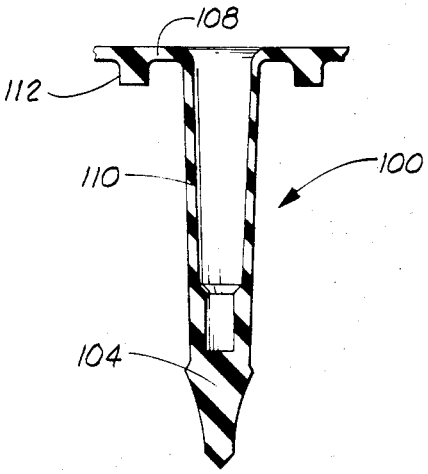
FIG. 12 is an enlarged side cross-sectional view of a piston portion of the device shown in FIG. 10.
Figure 13:
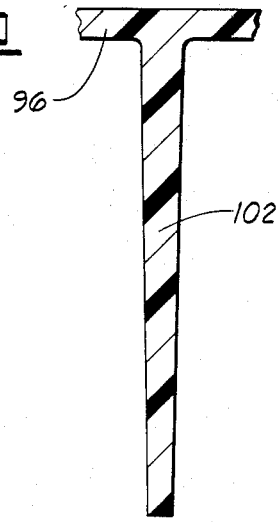
FIG. 13 is an enlarged side cross-sectional view of a rod portion of the device shown in FIG. 10.

Referring now to FIGS. 10–14 an alternate embodiment of the present invention is shown generally at 90. FIG. 10 is taken along generally the same lines as FIG. 1 except that only one of the tubes, pistons and rods is shown in cross-section. In this embodiment the reservoir tray is exactly the same as the reservoir tray in the above-described embodiment and, therefore, is not shown. The device 90 includes a draw tube plate 92, a piston tray 94 and a plunger tray 96. The draw tube plate 92 has an $8\times12$ array of draw tubes 98, the piston tray has an $8\times12$ array of elastomeric pistons 100 and the plunger tray 96 has an $8\times12$ array of rods 102. The rods 102 are disposed to extend into the pistons 100 which, in turn, extend into the draw tubes 98.

In contrast to the first embodiment described this embodiment utilizes the pistons 100 to resiliently urge the plunger tray 96 away from draw tube tray 92. Thus, there are no separate springs extending therebetween.

The piston 100 in the piston tray 94 have an end portion 104 which has the same shape and function as the piston 66 described in the first embodiment. The lower end 106 of draw tubes 98 is also shaped the same as the shape of draw tubes 20 in the first embodiment.

In this embodiment the piston tray 94 is formed of a single sheet of elastomeric material. This material could be lubricated Kraton (a trademark of Shell Chemical Co.) TPR or polyvinyl chloride polymers. This material should be of 40 durometer or less in order to allow sufficient stretching and resilient memory. The piston tray 94 includes a horizontal surface 108 down from which extend steadily narrowing thin walled tubes 110 which elastomerically connect the piston ends 104 to the surface 108.

A cylindrical short wall 112 extends downwardly from surface 108 closely around the cylinder 110. This wall 112 holds the surface 108 to force the stretching of cylinders 110 as the piston ends are urged away from surface 108.

When the piston tray 94 is inserted in the draw tube plate 92 the piston tips 104 extend to an intermediate height within the draw tubes 98. The rods 102 of plunger tray 96 press fit and are retained in the tips 104 as in the pistons 66. With the rods 102 inserted in the tips 104 the plunger plate 96 is separated from the surface 108. By pressing on the plunger tray 96 the rods 102 push the tips 104 downwardly until the extreme end of the tips 104 bottom out in the tubes 98. The elastomeric cylinders 110 resiliently urge the plunger tray 96 back to the original position after pressure on the plunger tray 96 is removed.

Figure 14:
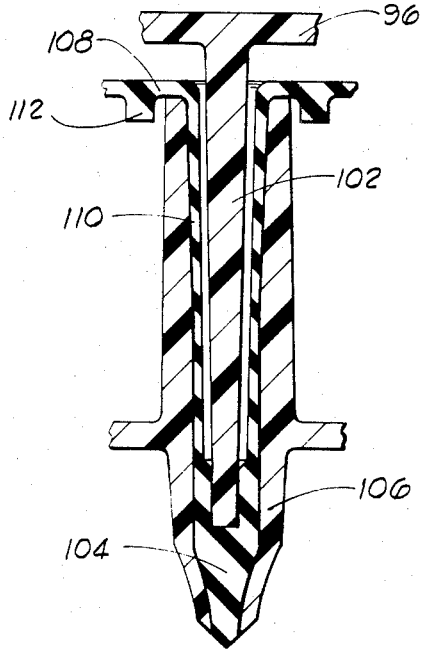
FIG. 14 is an enlarged side cross-sectional view of the assembled elements shown in FIGS. 11, 12 and 13.

As is apparent, the stroke of the piston tips 104 in the tubes 98 is dependent upon the relaxed length of the cylinders 110. By providing piston trays having differing cylinder lengths, predetermined dispensing and holding volumes can be achieved. If desired these piston trays can be combined with the elements described in the FIG. 9 embodiment to vary the stroke length as described in that embodiment. The upper and lower extremes of the piston strokes are shown in FIG. 10 and FIG. 14, respectively.

The upper ends of the draw tubes 98 include slots 114 to allow air to enter and exit the upper portion of the draw tubes around the elastomeric cylinders 110. It is preferable to have gaps between the cylinders 110, the walls of tube 98 and the rods 102. This allows the pistons to move within the cylinders without build up of pressure or vacuum between the tube 98 and the piston 100.

Operation of both of the embodiments is generally the same. To draw liquid from a well plate the combined plungers and tubes are manually suspended with the plungers depressed and the pistons at the lower extreme of the stroke. The tubes are then inserted in the reservoirs or wells and the finger pressure on the plungers is released. This allows the pistons to rise to the upper extreme of the stroke drawing a predetermined amount of liquid into the tubes. Of course, the tubes must be disposed in the liquid to a depth allowing this amount of liquid to be drawn. The plungers and tubes can then be manually removed from the wells with the liquid held in the tubes.

To dispense liquid the plungers are depressed to move the pistons to the lower extreme of the stroke expelling the liquid in the tubes. If desired the tubes can be placed in the same or a new tray of wells when the liquid is expelled. In this way predetermined amounts of liquid can be moved from tray to tray.

Thus, the device for drawing, holding and dispensing liquids of the present invention is well adapted to attain the objects and advantages mentioned as well as those inherent therein. While presently preferred embodiments of the invention have been described for the purpose of this disclosure, numerous changes in the construction and arrangement of parts can be made by those skilled in the art which changes are encompassed within the spirit of this invention as defined by the appended claims.

The foregoing disclosure and the showing made in the drawings are merely illustrative of the priciples of this invention and are not to be interpreted in a limiting sense.

What is claimed is:

1. A device for drawing, holding and dispensing a plurality of distinct liquid masses comprising:

a reservoir plate having a first set of vertical sides surrounding a plurality of liquid reservoirs disposed in an array configuration;

a draw tube plate having a draw tube plate frame and a plurality of draw tubes disposed in and connected to said draw tube plate frame in an array configuration, said draw tube plate including a second set of vertical sides which removably mate with said first set of vertical sides of said reservoir plate such that, when mated, each of said draw tubes extends to a predetermined depth into a selected one of said liquid reservoirs for drawing liquid therefrom and dispensing liquid thereto; and a plunger plate having a plunger plate frame which is captively received by said draw tube plate frame for sliding reciprocating motion therewith and having a plurality of plungers connected thereto and extended therefrom in an array configuration such that each of said plungers sealingly extends into a selected one of said draw tubes and such that application of an external hand pressure on an upper exterior portion of said plunger plate causes a corresponding axial stroke of said plungers, said stroke having a selectable axial length which results in the drawing and dispensing of a predetermined liquid volume.

2. The device of claim 1 which further comprises spring means disposed between said draw tube plate frame and said plunger plate frame for resiliently urging said draw tube plate frame away from said plunger plate frame.

3. The device of claim 2 wherein said spring means comprises a plastic flat spring connected to said plunger plate.

4. The device of claim 2 which further comprises:

means for restricting at predetermined distances the distance from which said draw tube plate frame can be separated from said plunger plate frame such that the quantity of a liquid which is drawn into, held and dispensed from said draw tubes can be varied to predetermined amounts thereby.

5. The device of claim 4 wherein said restricting means comprises a pin which can be fixed with respect to said draw tube plate frame to extend above and stop said plunger plate frame.

6. The device of claim 2 wherein said draw tube plate frame includes a hand grip surface for manual gripping and holding of said draw tube plate frame and wherein said plunger plate frame includes a finger press surface for manually pressing said plunger plate frame toward said draw tube plate frame and disposed with respect to said hand grip surface for single-hand reciprocating motion of said plunger plate frame with respect to said draw tube plate frame.

7. The device of claim 1 wherein each of said plungers comprises:

a rod having first and second ends, said first end being connected to said plunger plate frame; and a piston connected to said second end of said rod.

8. The device of claim 7 wherein:

each of said draw tubes has an upper end portion of uniform cylindical inner diameter and a lower end portion having an inverted generally conical inner surface shape with a relatively narrow opening at a lower end thereof; and wherein each said piston of said plungers has a first end portion connected to said second end of said rod, a second end portion having an inverted, generally conical shape for mating with said lower end portion of said draw tube, and a narrow cylindrical sealing surface disposed above said second end portion of said piston for sealingly fitting the inner diameter of said upper end portion of said draw tube.

9. The device of claim 8 wherein said lower end portion of said draw tube has an inverted, convex, conical inner surface shape and wherein said second end portion of said piston has an inverted concave concial shape for mating therewith so as to precisely squeeze liquid out of said draw tube as said surface shapes mate.

10. The device of claim 9 wherein said piston has a small hole disposed therein to prevent formation of a liquid drop on said piston when the lower end portion of said draw tube is mated with the second end portion of said piston.

11. The device of claim 7 wherein said piston is removable from said rod.

12. A device for drawing, holding and dispensing a plurality of distinct liquid masses comprising:

a reservoir plate having a first set of vertical sides surrounding a plurality of liquid reservoirs disposed in an array configuration;

a draw tube plate having a draw tube plate frame and a plurality of draw tubes disposed in and connected to said draw tube plate frame in an array configuration, said draw tube plate frame including a second set of vertical sides which detachably mate with said first set of vertical sides of said reservoir plate such that each of said draw tubes extends to a predetermined depth into a selected one of said liquid reservoirs for drawing liquid therefrom or dispensing liquid thereto;

a plunger plate having a plunger plate frame disposed for reciprocating motion with respect to said draw tube plate frame and having a plurality of plungers connected thereto and extended therefrom in an array configuration such that each of said plungers extends into a selected one of said draw tubes; and a piston plate formed of an elastomeric material and comprised of;

a piston plate frame which extends between said plunger plate frame and said draw tube plate frame;

a plurality of pistons each connected to one of said plungers and sealingly extending in one of said draw tubes for a predetermined distance; and a plurality of spring means each resiliently connecting said piston plate frame to one of said pistons and disposed between one of said plungers and one of said draw tubes and resiliently urging said plunger plate frame away from said draw tube plate frame such that application of external hand pressure on an upper exterior portion of said plunger plate causes a corresponding axial stroke of said pistons, said stroke having a selectable axial length, which results in the drawing or dispensing of a predetermined liquid volume.

13. The device of claim 12 which further comprises:

means for restricting at predetermined distances the distance from which said draw tube plate frame can be separated from said plunger plate frame such that the quantity of a liquid which is drawn into, held and dispensed from said draw tubes can be varied to predetermined amounts thereby.

14. The device of claim 12 wherein said draw tube plate frame includes a hand grip surface for manual gripping and holding of said draw tube plate frame and wherein said plunger plate frame includes a finger press surface for manually pressing said plunger plate frame toward said draw tube plate frame and disposed with respect to said hand grip surface for single-hand reciprocating motion of said plunger plate frame with respect to said draw tube plate frame.

15. The device of claim 12 wherein:

each of said draw tubes has an upper end portion of uniform cylindrical inner diameter and a lower end portion having an inverted generally conical inner surface shape with a relatively narrow opening at a lower end thereof; and wherein each of said pistons has a first end portion connected to said plungers, a second end portion having an inverted, generally conical shape for mating with said lower end portion of one of said draw tubes, and a narrow cylindrical sealing surface disposed above said second end portion of said piston for sealingly fitting the inner diameter of said upper end portion of said one of said draw tubes.

16. The device of claim 15 wherein said lower end portion of each of said draw tubes has an inverted, convex, conical inner surface shape and wherein said second end portion of each of said pistons has an inverted concave concial shape for mating therewith.

* * * * *